US009299292B2

(12) United States Patent
Tanaka et al.

(10) Patent No.: US 9,299,292 B2
(45) Date of Patent: Mar. 29, 2016

(54) DISPLAY DEVICE, ELECTRONIC DEVICE COMPRISING SAME, AND DRIVE METHOD FOR DISPLAY DEVICE

(71) Applicant: Sharp Kabushiki Kaisha, Osaka-shi, Osaka (JP)

(72) Inventors: Noriyuki Tanaka, Osaka (JP); Kouji Kumada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/378,663

(22) PCT Filed: Feb. 15, 2013

(86) PCT No.: PCT/JP2013/053655
§ 371 (c)(1),
(2) Date: Aug. 14, 2014

(87) PCT Pub. No.: WO2013/125458
PCT Pub. Date: Aug. 29, 2013

(65) Prior Publication Data

US 2015/0054863 A1 Feb. 26, 2015

(30) Foreign Application Priority Data

Feb. 24, 2012 (JP) ..... 2012-038916

(51) Int. Cl.
*G09G 3/36* (2006.01)
*G09G 3/34* (2006.01)

(52) U.S. Cl.
CPC ..... *G09G 3/3406* (2013.01); *G09G 3/3618* (2013.01); *G09G 3/3648* (2013.01); (Continued)

(58) Field of Classification Search
None
See application file for complete search history.

(56) References Cited

U.S. PATENT DOCUMENTS

2002/0093473 A1 7/2002 Tanaka et al.
2002/0180673 A1 12/2002 Tsuda et al.
(Continued)

FOREIGN PATENT DOCUMENTS

JP 2000-347762 A 12/2000
JP 2001-312253 A 11/2001
(Continued)

OTHER PUBLICATIONS

Official Communication issued in International Patent Application No. PCT/JP2013/053655, mailed on May 14, 2013.
(Continued)

*Primary Examiner* — Joseph Haley
(74) *Attorney, Agent, or Firm* — Keating & Bennett, LLP

(57) ABSTRACT

Provided is a display device capable of suppressing reduction in display quality even when pause drive is performed, while allowing the intensity of a light source to be changed in accordance with images to be displayed.

In a liquid crystal display device with the CABC function, 7.5-Hz pause drive is performed. A transition period is provided in which images to be displayed are changed gradually from bright image X to dark image Y. In the transition period, the duration of a sub-transition period is five frames. Once the transition period starts, the duration of a vertical display period changes from eight frames to one frame. That is, 7.5-Hz pause drive switches to 60-Hz normal drive. In this manner, the duration of the vertical display period is set to be less than or equal to the duration of the sub-transition period, so that screen refresh is always performed in each sub-transition period of the transition period.

20 Claims, 11 Drawing Sheets

(52) U.S. Cl.
CPC ..... *G09G3/3625* (2013.01); *G09G 2320/062* (2013.01); *G09G 2320/064* (2013.01); *G09G 2320/0646* (2013.01); *G09G 2320/103* (2013.01); *G09G 2330/022* (2013.01); *G09G 2340/0435* (2013.01)

(56) References Cited

U.S. PATENT DOCUMENTS

| | | | | |
|---|---|---|---|---|
| 2004/0036669 | A1 | 2/2004 | Yanagi et al. | |
| 2009/0189922 | A1 * | 7/2009 | Toyooka ..... | G09G 3/2022 345/690 |
| 2012/0242923 | A1 | 9/2012 | Miyamoto et al. | |
| 2014/0015869 | A1 | 1/2014 | Takahashi et al. | |

FOREIGN PATENT DOCUMENTS

| | | | |
|---|---|---|---|
| JP | 2002-278523 | A | 9/2002 |
| JP | 2004-078124 | A | 3/2004 |
| JP | 2005-037685 | A | 2/2005 |
| WO | 2011/104791 | A1 | 9/2011 |
| WO | 2012/141142 | A1 | 10/2012 |

OTHER PUBLICATIONS

Tanaka et al., "Display Device, Electronic Device Comprising Same, and Drive Method for Display Device", U.S. Appl. No. 14/378,667, filed Aug. 14, 2014.

* cited by examiner

DISPLAY DEVICE, ELECTRONIC DEVICE COMPRISING SAME, AND DRIVE METHOD FOR DISPLAY DEVICE

TECHNICAL FIELD

The present invention relates to display devices, particularly to a display device in which pause drive is performed, an electronic device including the display device, and a method for driving the display device.

BACKGROUND ART

Conventionally, there is some demand for a reduction in power consumption in display devices such as liquid crystal display devices. Accordingly, for example, Patent Document 1 discloses a display device drive method in which a scanning period (also called a refresh period) T1, in which screen refresh is performed by scanning gate lines of a liquid crystal display device, is followed by a pause period (no-refresh period) T2, in which the refresh is paused by stopping the scanning of all of the gate lines. For example, it is possible to make settings such that control signals are not provided to a gate driver and/or a source driver during the pause period T2. As a result, it is possible to pause the operation of the gate driver and/or the operation of the source driver, resulting in reduced power consumption. The drive performed with the refresh period followed by the no-refresh period, as in the drive method described in Patent Document 1, is called, for example, "pause drive". Note that pause drive is also called "low-frequency drive" or "intermittent drive". The pause drive as above is suitable for displaying still images. Besides Patent Document 1, for example, Patent Documents 2 to 5 disclose inventions relevant to pause drive.

Furthermore, as a technology to reduce power consumption, the CABC (Content Adaptive Brightness Control) function is known in which the backlight intensity of a display device, such as a liquid crystal display device, provided with a backlight is changed in accordance with the brightness of an image to be displayed on the screen of its display portion (also simply referred to below as an "image to be displayed"). In the CABC function, for example, the backlight intensity is controlled in accordance with a pulse-width modulation signal outputted by a display control circuit in the liquid crystal display device. The backlight intensity is determined by the duty cycle of the pulse-width modulation signal. That is, in such a liquid crystal display device with the CABC function, the image to be displayed and the backlight intensity (the duty cycle of the pulse-width modulation signal) are correlated with each other. In the following, the value of the duty cycle of the pulse-width modulation signal is denoted by the symbol "DR". For example, in the case where a dark image is displayed, with the CABC function, which correlates the image to be displayed and the backlight intensity, it is possible to set the backlight intensity low, resulting in low backlight power consumption. Note that the CABC function is effected (i.e., on), for example, when an image darker than a certain brightness level is displayed.

CITATION LIST

Patent Documents

Patent Document 1: Japanese Laid-Open Patent Publication No. 2001-312253

Patent Document 2: Japanese Laid-Open Patent Publication No. 2000-347762

Patent Document 3: Japanese Laid-Open Patent Publication No. 2002-278523

Patent Document 4: Japanese Laid-Open Patent Publication No. 2004-78124

Patent Document 5: Japanese Laid-Open Patent Publication No. 2005-37685

SUMMARY OF THE INVENTION

Problems to be Solved by the Invention

Now consider a case where pause drive is performed in a conventional liquid crystal display device with the CABC function. FIG. 11 illustrates a case where images to be displayed on the conventional liquid crystal display device are changed from bright image X to dark image Y. In FIG. 11, "R" denotes a frame in which the screen is refreshed (referred to below as a "refresh frame"), and "N" denotes a frame in which the screen refresh is paused (referred to below as a "no-refresh frame"). The refresh rate is assumed to be 7.5 Hz. That is, the screen is refreshed once per eight frames. In the case of the CABC function, when it is necessary to change the duty cycle of a pulse-width modulation signal to some great extent (e.g., to change the cycle from DR=100 to DR=90), a transition period is provided in which the image to be displayed and the duty cycle are changed gradually. In the case where normal drive (60 Hz) is performed, the screen is refreshed every frame, and therefore, the screen can be changed in accordance with changes in the duty cycle. As a result, for example, in the case where bright images are continuously being displayed on the screen, even if the screen changes to a dark image abruptly with a sudden change of the backlight intensity, it is possible to prevent a viewer from feeling uncomfortable (i.e., it is possible to prevent a reduction in display quality).

However, in the case where pause drive is performed as shown in FIG. 11, the screen is not refreshed every frame, the image to be displayed and the duty cycle of the pulse-width modulation signal do not change in correlation with the screen. More specifically, during the transition period, the image to be displayed changes every five frames, in order from image A up to image I, and even if the value of DR changes correspondingly every five frames, refresh is performed only every eight frames. Accordingly, the image displayed on the screen changes in the order, as shown in FIG. 11: image B, image C, image E, image G, and image H. Here, the relationship among the images to be displayed in terms of brightness is such that image X>image A> image B> . . . >image H>image I>image Y. In the case of pause drive, some of the images that should originally be displayed on the screen during the transition period are omitted, as shown in FIG. 11. As a result, the images to be displayed on the screen do not correspond to the duty cycles of the pulse-width modulation signal that should correspond to those images. That is, the images displayed on the screen do not correspond to the backlight intensities that should originally correspond to those images. Accordingly, the images displayed on the screen during the transition period have different brightness from their original brightness. As a result, in the case where pause drive is performed, when compared to the case where normal drive is performed, it is not possible to sufficiently suppress reduction in display quality due to the use of the CABC function.

Therefore, an objective of the present invention is to provide a display device capable of suppressing reduction in display quality even when pause drive is performed, while allowing the intensity of a light source to be changed in accordance with images to be displayed, and other objectives thereof are to provide an electronic device including the display device, and a method for driving the display device.

Solution to the Problems

A first aspect of the present invention is directed to a display device with a display portion and a light source, the display portion including a plurality of image forming portions, the light source illuminating the display portion and having an intensity changeable in accordance with images to be displayed on a screen of the display portion, the display device comprising:

a display drive portion for driving the display portion;

a light source drive portion for driving the light source; and a control portion for controlling the display drive portion in accordance with externally received data, wherein, the control portion includes a refresh rate control portion for controlling a refresh rate determined in accordance with the proportion of a refresh period for refreshing the screen and a no-refresh period for pausing the refreshing of the screen, and in a transition period in which the intensity of the light source gradually changes in accordance with gradual changes of the images to be displayed from a first image to a second image, a first period from the start of the refresh period to the start of another refresh period immediately following the refresh period has a duration less than or equal to a duration of a second period corresponding to a phase of the change in intensity of the light source.

In a second aspect of the present invention, based on the first aspect of the invention, the control portion further includes an intensity control portion for performing control to change the intensity of the light source in accordance with data included in the externally received data and representing the images to be displayed.

In a third aspect of the present invention, based on the second aspect of the invention, the refresh rate control portion changes the refresh rate such that the first period of the transition period is the refresh period.

In a fourth aspect of the present invention, based on the second aspect of the invention, the first period of the transition period includes the refresh period and the no-refresh period.

In a fifth aspect of the present invention, based on the fourth aspect of the invention, the refresh rate control portion sets the duration of the first period of the transition period in accordance with the duration of the second period.

In a sixth aspect of the present invention, based on the fourth aspect of the invention, the intensity control portion sets the duration of the second period of the transition period in accordance with the duration of the first period.

In a seventh aspect of the present invention, based on the first aspect of the invention, the duration of the second period is a natural number multiple of the duration of the first period.

In an eighth aspect of the present invention, based on any of the first through seventh aspects of the invention, the image forming portion includes a thin-film transistor with a control terminal connected to a scanning line in the display portion, a first conductive terminal connected to a signal line in the display portion, a second conductive terminal to which a voltage in accordance with the image to be displayed is applied, the second conductive terminal being connected to a pixel electrode in the display portion, and a channel layer made of an oxide semiconductor.

A ninth aspect of the present invention is directed to an electronic device comprising:

a display device of the first aspect; and an intensity control portion for performing control to change the intensity of the light source in accordance with the images to be displayed.

In a tenth aspect of the present invention, based on the ninth aspect of the invention, the refresh rate control portion changes the refresh rate such that the first period of the transition period is the refresh period.

In an eleventh aspect of the present invention, based on the ninth aspect of the invention, the first period of the transition period includes the refresh period and the no-refresh period.

In a twelfth aspect of the present invention, based on the eleventh aspect of the invention, the refresh rate control portion sets the duration of the first period of the transition period in accordance with the duration of the second period of the transition period.

In a thirteenth aspect of the present invention, based on the eleventh aspect of the invention, the intensity control portion sets the duration of the second period of the transition period in accordance with the duration of the first period.

In a fourteenth aspect of the present invention, based on any of the ninth to thirteenth aspects of the invention, the image forming portion includes a thin-film transistor with a control terminal connected to a scanning line in the display portion, a first conductive terminal connected to a signal line in the display portion, a second conductive terminal to which a voltage in accordance with the image to be displayed is applied, the second conductive terminal being connected to a pixel electrode in the display portion, and a channel layer made of an oxide semiconductor.

A fifteenth aspect of the present invention is directed to a method for driving a display device with a display portion including a plurality of image forming portions, a display drive portion for driving the display portion, a light source for illuminating the display portion, a light source drive portion for driving the light source, and a control portion for controlling the display drive portion in accordance with externally received data, the method comprising:

a transition step of setting a duration of a first period of a transition period to be less than or equal to a duration of a second period, the transition period being a period in which the intensity of the light source gradually changes in accordance with gradual changes of the images to be displayed from a first image to a second image, the first period lasting from the start of a refresh period for refreshing the screen to the start of another refresh period immediately following the refresh period, the second period corresponding to a phase of the change in intensity of the light source, wherein, the transition step includes a refresh rate control step of controlling a refresh rate determined in accordance with the proportion of the refresh period and a no-refresh period for pausing the refreshing of the screen.

In a sixteenth aspect of the present invention, based on the fifteenth aspect of the invention, in the refresh rate control step, the refresh rate is changed such that the first period of the transition period is the refresh period.

In a seventeenth aspect of the present invention, based on the fifteenth aspect of the invention, the first period of the transition period includes the refresh period and the no-refresh period.

In an eighteenth aspect of the present invention, based on the seventeenth aspect of the invention, in the refresh rate control step, the duration of the first period of the transition period is set in accordance with the duration of the second period.

In a nineteenth aspect of the present invention, based on the seventeenth aspect of the invention, in the transition step, the duration of the second period of the transition period is set in accordance with the duration of the first period.

In a twentieth aspect of the present invention, based on the fifteenth aspect of the invention, in the transition step, the duration of the second period is set to a natural number multiple of the duration of the first period.

Effect of the Invention

In the first aspect of the present invention, the duration of the first period is less than or equal to the second period during the transition period in which the intensity of the light source gradually changes in accordance with gradual changes of the images to be displayed from a first image to a second image. Accordingly, the screen is always refreshed in each phase of the change in intensity of the light source. As a result, during the transition period, the image displayed on the screen corresponds to the intensity of the light source that should originally correspond to that image. Therefore, during the transition period, the image displayed on the screen has its original brightness. Thus, for example, even in the case where pause drive with the refresh period followed by the no-refresh period is performed, as in the case where normal drive with only the refresh period is performed, it is possible to sufficiently suppress reduction in display quality due to the use of the function of changing the intensity of the light source in accordance with the image to be displayed on the screen (e.g., the CABC function).

The second aspect of the present invention renders it possible to achieve similar effects to those achieved by the first aspect of the present invention, even in modes for which the intensity control portion is provided in the control portion.

In the third or tenth aspect of the present invention, the screen is always refreshed in each phase of the change in intensity of the light source during the transition period. Thus, during the transition period, it is possible to more reliably ensure that the image displayed on the screen corresponds to the intensity of the light source that should originally correspond to that image.

In the fourth or eleventh aspect of the present invention, pause drive is performed during the transition period. Thus, it is possible to further reduce power consumption compared to the third or tenth aspect of the invention.

In the fifth or twelfth aspect of the present invention, the duration of the first period of the transition period is set in accordance with the duration of the second period, whereby it is possible to achieve similar effects to those achieved by the fourth or eleventh aspect of the invention.

In the sixth or thirteenth aspect of the present invention, the duration of the second period of the transition period is set in accordance with the duration of the first period, whereby it is possible to achieve similar effects to those achieved by the fourth or eleventh aspect of the invention. Moreover, it is not necessary to change the duration of the first period, i.e., it is not necessary to change the refresh rate, and therefore, for example, in the case where drive with a relatively low refresh rate is performed during periods other than the transition period, it is possible to further reduce power consumption compared to the fifth or twelfth aspect of the invention.

In the seventh aspect of the present invention, the duration of the second period is a natural number multiple of the duration of the first period, whereby it is possible to more reliably ensure that the image displayed on the screen corresponds to the intensity of the light source that should originally correspond to that image.

In the eighth or fourteenth aspect of the present invention, a thin-film transistor with a channel layer made of an oxide semiconductor is used as the thin-film transistor in the image forming portion. Thus, it is possible to reliably hold a voltage written in the image forming portion. In addition, it is possible to further suppress reduction in display quality.

The ninth aspect of the present invention allows an electronic device including a display device and an intensity control portion to achieve similar effects to those achieved by the first aspect of the invention.

The fifteenth aspect of the present invention allows a display device drive method to achieve similar effects to those achieved by the first aspect of the invention.

The sixteenth aspect of the present invention allows the display device drive method to achieve similar effects to those achieved by the third or tenth aspect of the invention.

The seventeenth aspect of the present invention allows the display device drive method to achieve similar effects to those achieved by the fourth or eleventh aspect of the invention.

The eighteenth aspect of the present invention allows the display device drive method to achieve similar effects to those achieved by the fifth or twelfth aspect of the invention.

The nineteenth aspect of the present invention allows the display device drive method to achieve similar effects to those achieved by the sixth or thirteenth aspect of the invention.

The twentieth aspect of the present invention allows the display device drive method to achieve similar effects to those achieved by the seventh aspect of the invention.

MODES FOR CARRYING OUT THE INVENTION

Hereinafter, first through fourth embodiments of the present invention will be described with reference to the accompanying drawings. In the following embodiments, "one frame" refers to a frame (16.67 ms) for a general display device with a refresh rate of 60 Hz. Moreover, drive performed at a refresh rate of X Hz (where X>0) will be referred to below as "X-Hz drive". Furthermore, in some cases, to perform screen refresh will be simply referred to below as "to perform refresh".

<1. First Embodiment>

<1.1 Overall Configuration and Summarized Operation>

Figure 1:
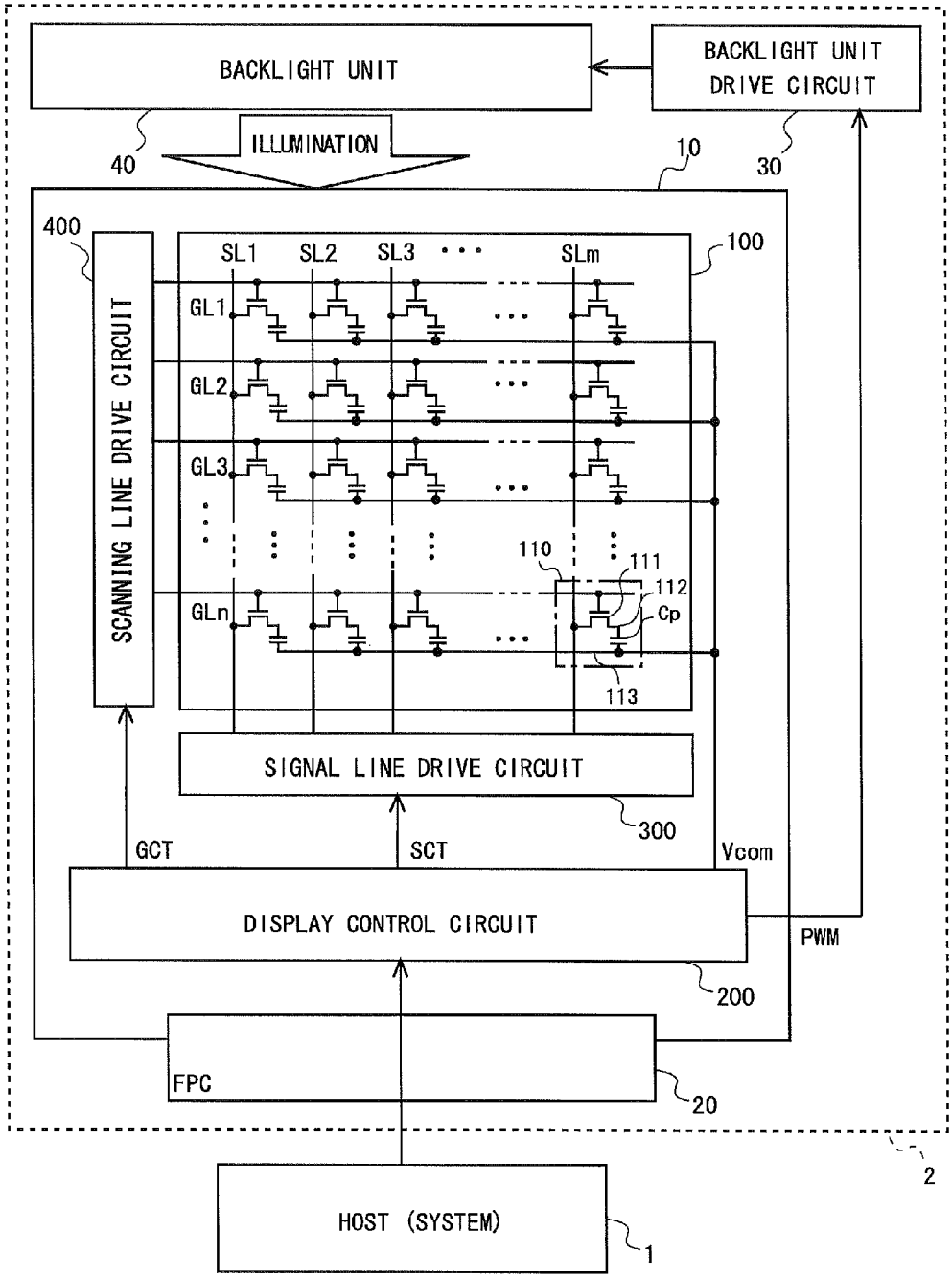
FIG. 1 is a block diagram illustrating the configuration of an electronic device according to a first embodiment of the present invention.

FIG. 1 is a block diagram illustrating the configuration of an electronic device according to the first embodiment of the present invention. This electronic device consists of a host (system) 1 and a liquid crystal display device 2. The host 1 has a CPU as a main component. The liquid crystal display device 2 includes a liquid crystal display panel 10, a backlight unit drive circuit 30, which acts as a light source drive portion, and a backlight unit 40. The liquid crystal display panel 10 is transmissive or semi-transmissive. The liquid crystal display panel 10 is provided with an FPC (Flexible Printed Circuit) 20 for external connection. In addition, a display portion 100, a display control circuit 200, which acts as a control portion, a signal line drive circuit 300, and a scanning line drive circuit 400 are provided on a substrate of the liquid crystal display panel 10. Note that both or one of the signal line drive circuit 300 and the scanning line drive circuit 400 may be provided in the display control circuit 200. Alternatively, both or one of the signal line drive circuit 300 and the scanning line drive circuit 400 may be integrally formed with the display portion 100. The display portion 100 has formed thereon a plurality (m) of signal lines SL1 to SLm, a plurality (n) of scanning lines GL1 to GLn, and a plurality (m×n) of image forming portions 110 provided corresponding to the intersections of the m signal lines SL1 to SLm and the n scanning lines GL1 to GLn. In the following, where the m signal lines SL1 to SLm are not distinguished from one another, they will simply be referred to as "signal lines SL", and where the n scanning lines GL1 to GLn are not distinguished from one another, they will simply be referred to as "scanning lines GL". The m×n image forming portions 110 are provided in a matrix. Each image forming portion 110 includes a TFT 111, which has a gate terminal acting as a control terminal and connected to a scanning line GL passing through its corresponding intersection, and a source terminal acting as a first conductive terminal and connected to a signal line SL passing through the intersection, a pixel electrode 112 connected to a drain terminal of the TFT 111, which acts as a second conductive terminal, a common electrode 113 provided commonly for the m×n image forming portions 110, and a liquid crystal layer commonly provided for the m×n image forming portions 110 between the pixel electrode 112 and the common electrode 113. In addition, there is provided pixel capacitance Cp, which is liquid crystal capacitance created by the pixel electrode 112 and the common electrode 113. Note that typically, to reliably hold a voltage in the pixel capacitance Cp, auxiliary capacitance is provided parallel to the liquid crystal capacitance, and therefore, practically, the pixel capacitance Cp includes the liquid crystal capacitance and the auxiliary capacitance.

In the present embodiment, a TFT which uses, for example, an oxide semiconductor for a channel layer (referred to below as an "oxide TFT") is used as the TFT 111. More specifically, the channel layer of the TFT 111 is made with IGZO (InGaZnOx) mainly composed of indium (In), gallium (Ga), zinc (Zn), and oxygen (O). In the following, a TFT which uses IGZO for a channel layer will be referred to as an "IGZO-TFT". The IGZO-TFT has a considerably lower off-leak current than silicon-based TFTs which use amorphous silicon or suchlike for their channel layers. Accordingly, a voltage written in the pixel capacitance Cp can be held for a longer period of time. Note that similar effects can be achieved also in the case where the channel layer is made with an oxide semiconductor other than IGZO, including, for example, at least one of the following: indium, gallium, zinc, copper (Cu), silicon (Si), tin (Sn), aluminum (Al), calcium (Ca), germanium (Ge), and lead (Pb). Moreover, the oxide TFT used as the TFT 111 is merely an illustrative example, and a silicon-based TFT or suchlike can instead be used.

The display control circuit 200 is typically realized as an IC (Integrated Circuit). The display control circuit 200 receives data DAT from the host 1 via the FPC 20, and correspondingly generates and outputs a signal line control signal SCT, a scanning line control signal GCT, a pulse-width modulation signal PWM, and a common potential Vcom. The signal line control signal SCT is provided to the signal line drive circuit 300. The scanning line control signal GCT is provided to the scanning line drive circuit 400. The pulse-width modulation signal PWM is provided to the backlight unit drive circuit 30. The common potential Vcom is provided to the common electrode 113. In the present embodiment, for example, the data DAT is exchanged between the host 1 and the display control circuit 200 through an interface which supports the DSI (Display Serial Interface) standard proposed by the MIPI (Mobile Industry Processor Interface) Alliance. The interface which supports the DSI standard allows high-speed data transmission. In the present embodiment, the interface which supports the DSI standard is used in video mode or command mode.

In accordance with the signal line control signal SCT, the signal line drive circuit 300 generates and outputs drive video signals to the signal lines SL. The signal line control signal SCT includes, for example, digital video signals corresponding to RGB data RGBD, as well as a source start pulse signal, a source clock signal, and a latch strobe signal. The signal line drive circuit 300 causes its unillustrated internal components, such as a shift register and a sampling latch circuit, to operate in accordance with the source start pulse signal, the source clock signal, and the latch strobe signal, and also causes an unillustrated DA conversion circuit to convert digital signals resulting from the digital video signals into analog signals, thereby generating the drive video signals.

In accordance with the scanning line control signal GCT, the scanning line drive circuit 400 repeats applying active scanning signals to the scanning lines GL in predetermined cycles. The scanning line control signal GCT includes, for example, a gate clock signal and a gate start pulse signal. The scanning line drive circuit 400 causes its unillustrated internal components, such as a shift register, to operate in accordance with the gate clock signal and the gate start pulse signal, thereby generating the scanning signals. The scanning line drive circuit 400, along with the signal line drive circuit 300, functions as a display drive portion.

The backlight unit 40 is provided behind the liquid crystal display panel 10, so as to irradiate the back of the liquid crystal display panel 10 with backlight. The backlight unit 40 typically includes a plurality of LEDs (Light Emitting Diodes) acting as light sources. Note that for example, CCFLs (Cold Cathode Fluorescent Lamps) may be used in place of the LEDs. The intensity of the LEDs (corresponding to the aforementioned backlight intensity) is controlled by the backlight unit drive circuit 30. The backlight unit drive circuit 30 determines the intensity of the LEDs in accordance with the pulse-width modulation signal PWM. More specifically, the intensity of the LEDs increases with the duty cycle of the pulse-width modulation signal PWM. However, the method for adjusting the intensity of the LEDs is not limited to this, and various modifications can be made.

In this manner, the backlight unit 40 is driven by applying the drive video signals to the signal lines SL and the scanning signals to the scanning lines, so that the display portion 100 of the liquid crystal display panel 10 displays a screen in accordance with the image data transmitted by the host 1.

<1.2 Configuration of the Display Control Circuit>

In the following, the configuration of the display control circuit 200 will be described with respect to three different modes. The first mode is a video mode for which no RAM (Random Access Memory) is provided. The first mode will be referred to below as a "video mode without RAM". The second mode is a video mode for which RAM is provided. The second mode will be referred to below as a "video mode with RAM capture". The third mode is a command mode for which RAM is provided. The third mode will be referred to below as a "command mode with RAM write". Note that the present invention is not limited by the interface that supports the DSI standard, and the configuration of the display control circuit 200 is not limited by the three modes described herein.

<1.2.1 Video Mode without RAM>

Figure 2:
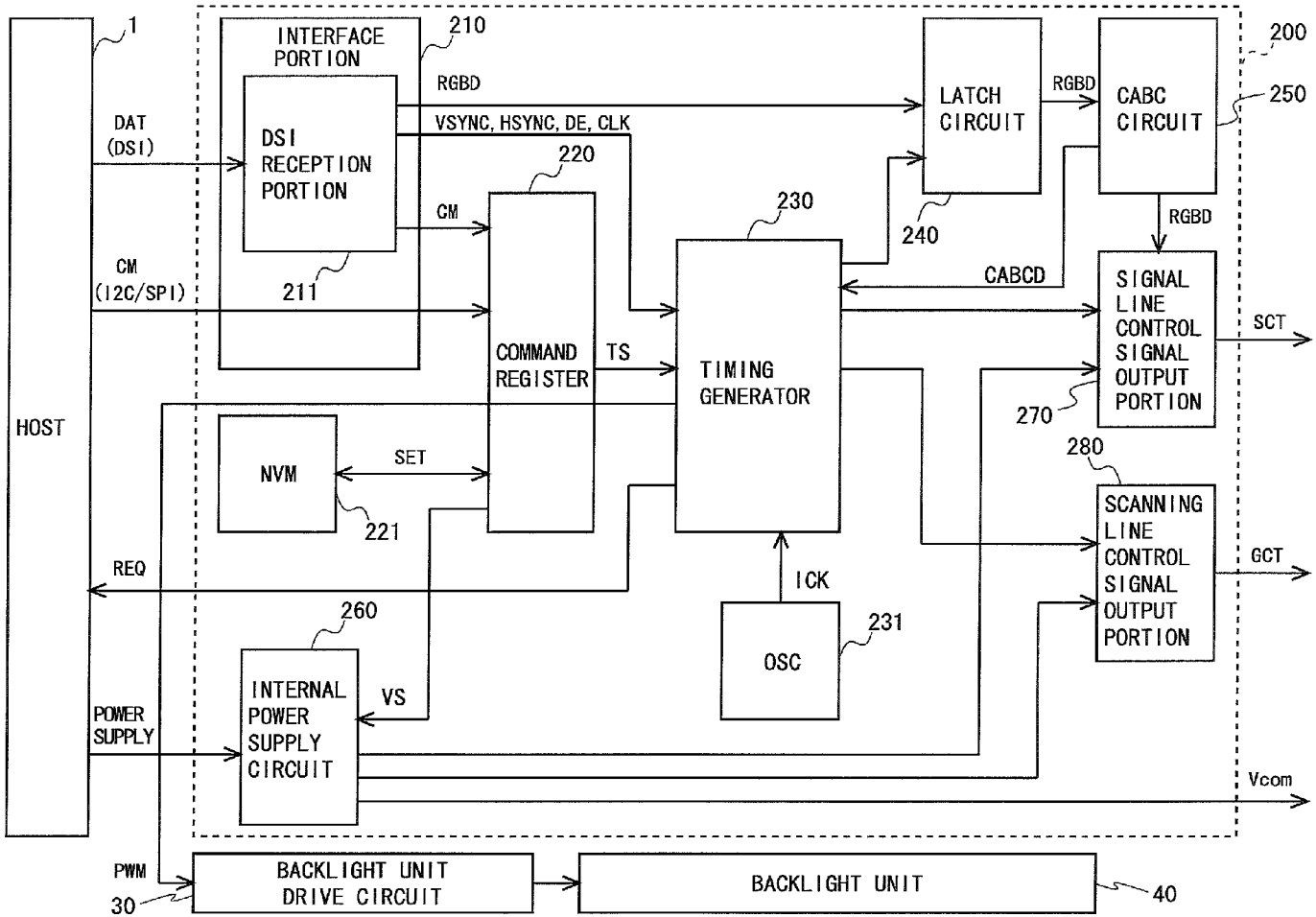
FIG. 2 is a block diagram describing the configuration of a display control circuit supporting the video mode without RAM in the first embodiment.

FIG. 2 is a block diagram describing the configuration of a display control circuit 200 supporting the video mode without RAM (referred to below as the "display control circuit 200 for the video mode without RAM") in the present embodiment. As shown in FIG. 2, the display control circuit 200 includes an interface portion 210, a command register 220, NVM (non-volatile memory) 221, a timing generator 230, an OSC (oscillator) 231, a latch circuit 240, a CABC circuit 250, an internal power supply circuit 260, a signal line control signal output portion 270, and a scanning line control signal output portion 280. The interface portion 210 includes a DSI reception portion 211. Note that both or one of the signal line drive circuit 300 and the scanning line drive circuit 400 may be provided in the display control circuit 200, as described above.

The DSI reception portion 211 in the interface portion 210 supports the DSI standard. Data DAT for the video mode includes RGB data RGBD, which represents data for an image to be displayed, synchronization signals, including a vertical synchronization signal VSYNC, a horizontal synchronization signal HSYNC, a data enable signal DE, and a clock signal CLK, and command data CM. The command data CM includes data for a variety of types of control. Upon reception of the data DAT from the host 1, the DSI reception portion 211 transmits the RGB data RGBD included in the data DAT to the latch circuit 240, the vertical synchronization signal VSYNC, the horizontal synchronization signal HSYNC, the data enable signal DE, and the clock signal CLK to the timing generator 230, and the command data CM to the command register 220. Note that the command data CM may be transmitted by the host 1 to the command register 220 via an interface which supports the I2C (Inter-Integrated Circuit) standard or the SPI (Serial Peripheral Interface) standard. In such a case, the interface portion 210 includes a reception portion which supports the I2C standard or the SPI standard.

The command register 220 holds the command data CM. The NVM 221 holds setting data SET for a variety of types of control. The command register 220 reads the setting data SET being held in the NVM 221, and updates the setting data SET in accordance with the command data CM. In accordance with the command data CM and the setting data SET, the command register 220 transmits a timing control signal TS to the timing generator 230, and a voltage setting signal VS to the internal power supply circuit 260.

In accordance with the vertical synchronization signal VSYNC, the horizontal synchronization signal HSYNC, the data enable signal DE, the clock signal CLK, and the timing control signal TS, as well as an internal clock signal ICK generated by the OSC 231, the timing generator 230 transmits control signals to control the latch circuit 240, the signal line control signal output portion 270, and the scanning line control signal output portion 280. Further, in accordance with the vertical synchronization signal VSYNC, the horizontal synchronization signal HSYNC, the data enable signal DE, the clock signal CLK, and the timing control signal TS, the timing generator 230 generates a request signal REQ on the basis of the internal clock signal ICK generated by the OSC 231, and transmits the request signal REQ to the host 1. The request signal REQ is a signal to request the host 1 to transmit data DAT. Note that the OSC 231 is dispensable for the display control circuit 200 for the video mode without RAM. Moreover, the timing generator 230 receives CABC processing data CABCD to be described later from the CABC circuit 250, and in accordance with the data, the timing generator 230 generates and transmits a pulse-width modulation signal PWM to the backlight unit drive circuit 30. Note that the pulse-width modulation signal PWM may be transmitted to the backlight unit drive circuit 30 via the command register 220.

The latch circuit 240, under control of the timing generator 230, transmits RGB data RGBD for one line to the signal line control signal output portion 270.

The CABC circuit 250 determines the brightness of the image to be displayed, which is represented by the RGB data RGBD received from the latch circuit 240. The CABC circuit 250 transmits CABC processing data CABCD to the timing generator 230 as a determination result. The CABC processing data CABCD indicates, for example, the brightness of the image to be displayed, which is represented by the RGB data RGBD. The CABC processing data CABCD may indicate a change in brightness compared to an image represented by immediately preceding RGB data RGBD received. Upon reception of the CABC processing data CABCD, the timing generator 230 generates a pulse-width modulation signal PWM in accordance with the CABC processing data CABCD, as described above, and transmits the pulse-width modulation signal PWM to the backlight unit drive circuit 30. The duty cycle of the pulse-width modulation signal PWM to be transmitted varies depending on the CABC processing data CABCD. For example, the brighter the image to be displayed that is represented by the RGB data RGBD, the higher the duty cycle of the pulse-width modulation signal PWM is set, and the darker the image to be displayed that is represented by the RGB data RGBD, the lower the duty cycle of the pulse-width modulation signal PWM is set. In this manner, the CABC circuit 250 functions as an intensity control portion. Note that the CABC function is described herein as "off" where DR=100, and also as "on" where DR<100.

The CABC circuit 250 transmits the CABC processing data CABCD as a determination result, as described above, and also performs data conversion on the received RGB data RGBD. For example, the conversion is performed on the RGB data RGBD such that the image to be displayed becomes brighter with a decrease of an LED intensity obtained from the pulse-width modulation signal PWM generated in accordance with the CABC processing data CABCD (such conversion will be referred to below as "LED intensity-adapted data conversion"). This renders it possible to prevent an image displayed on the screen from being darker than desired brightness while decreasing the LED intensity.

The RGB data RGBD subjected to the conversion is transmitted to the signal line control signal output portion 270.

On the basis of power supplied by the host 1 and in accordance with the voltage setting signal VS provided by the command register, the internal power supply circuit 260 generates and outputs a common potential Vcom as well as power supply voltages to be used by the signal line control signal output portion 270 and the scanning line control signal output portion 280.

On the basis of the RGB data RGBD from the CABC circuit 250, the control signal from the timing generator 230, and the power supply voltage from the internal power supply circuit 260, the signal line control signal output portion 270 generates and outputs a signal line control signal SCT to the signal line drive circuit 300.

On the basis of the control signal from the timing generator 230 and the power supply voltage from the internal power supply circuit 260, the scanning line control signal output portion 280 generates and outputs a scanning line control signal GCT to the scanning line drive circuit 400.

<1.2.2 Video Mode with RAM Capture>

Figure 3:
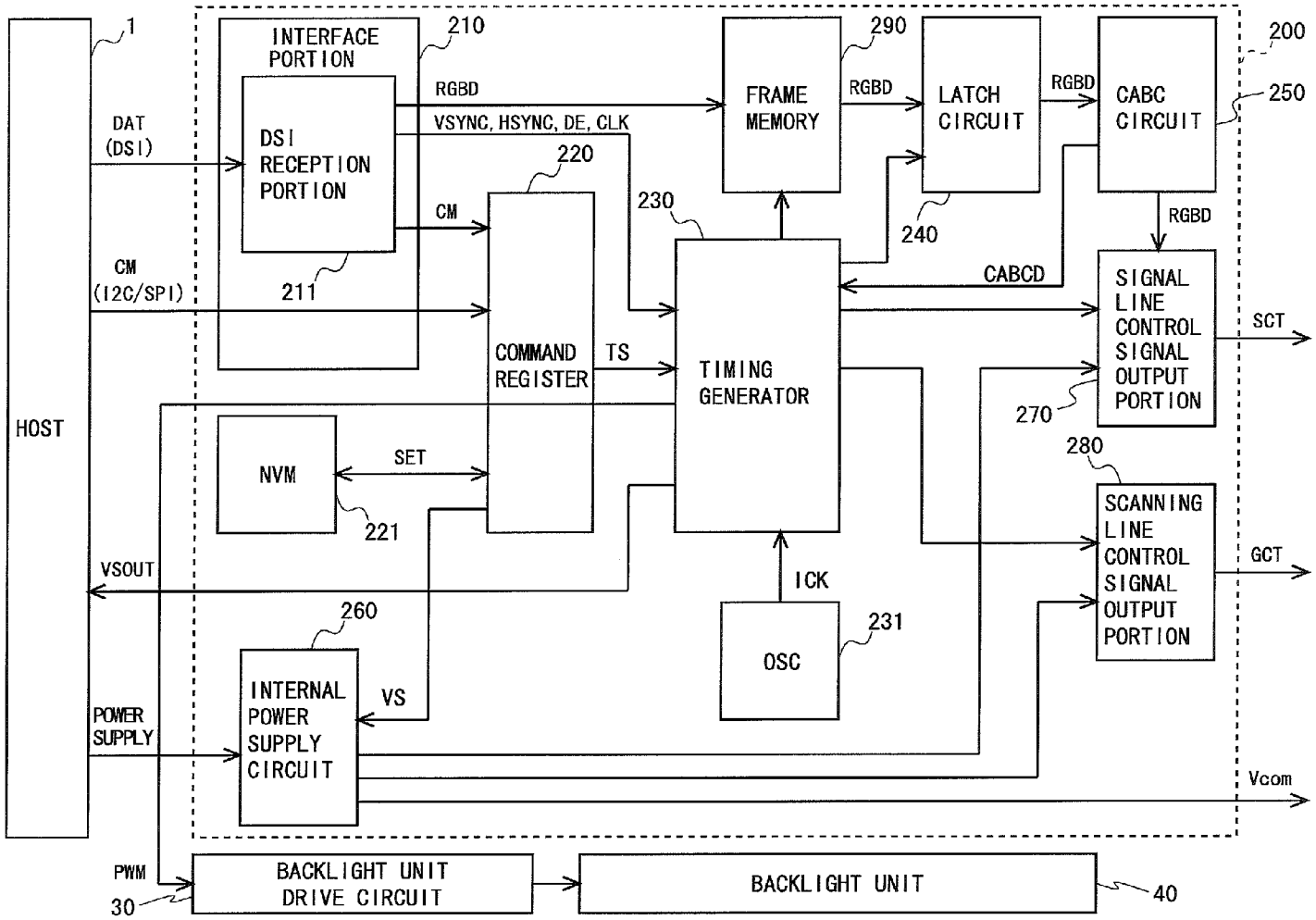
FIG. 3 is a block diagram describing the configuration of a display control circuit supporting the video mode with RAM capture in the first embodiment.

FIG. 3 is a block diagram describing the configuration of a display control circuit 200 supporting the video mode with RAM capture (referred to below as the "display control circuit 200 for the video mode with RAM capture") in the present embodiment. As shown in FIG. 3, the display control circuit 200 for the video mode with RAM capture is obtained by adding frame memory (RAM) 290 to the display control circuit 200 for the video mode without RAM.

In the display control circuit 200 for the video mode without RAM, the DSI reception portion 211 transmits the RGB data RGBD directly to the latch circuit 240, but in the display control circuit 200 for the video mode with RAM capture, the RGB data RGBD transmitted by the DSI reception portion 211 is held in the frame memory 290. The latch circuit 240 reads the RGB data RGBD being held in the frame memory 290 in accordance with a control signal generated by the timing generator 230. Moreover, the timing generator 230 transmits a vertical synchronization output signal VSOUT to the host 1, instead of the request signal REQ. The vertical synchronization output signal VSOUT is a signal to control the timing of the host 1 transmitting the data DAT such that the timing of the RGB data RGBD being written to the frame memory 290 does not overlap the timing of the RGB data RGBD being read from the frame memory 290. Other features and operations of the display control circuit 200 for the video mode with RAM capture are the same as those of the display control circuit 200 for the video mode without RAM, and therefore, any descriptions thereof will be omitted. Note that the OSC 231 is dispensable for the display control circuit 200 for the video mode with RAM capture.

In the display control circuit 200 for the video mode with RAM capture, the frame memory 290 is capable of holding the RGB data RGBD, and therefore, the host 1 is not required to transmit data DAT to the display control circuit 200 more than once when the screen is not updated.

<1.2.3 Command Mode with RAM Write>

Figure 4:
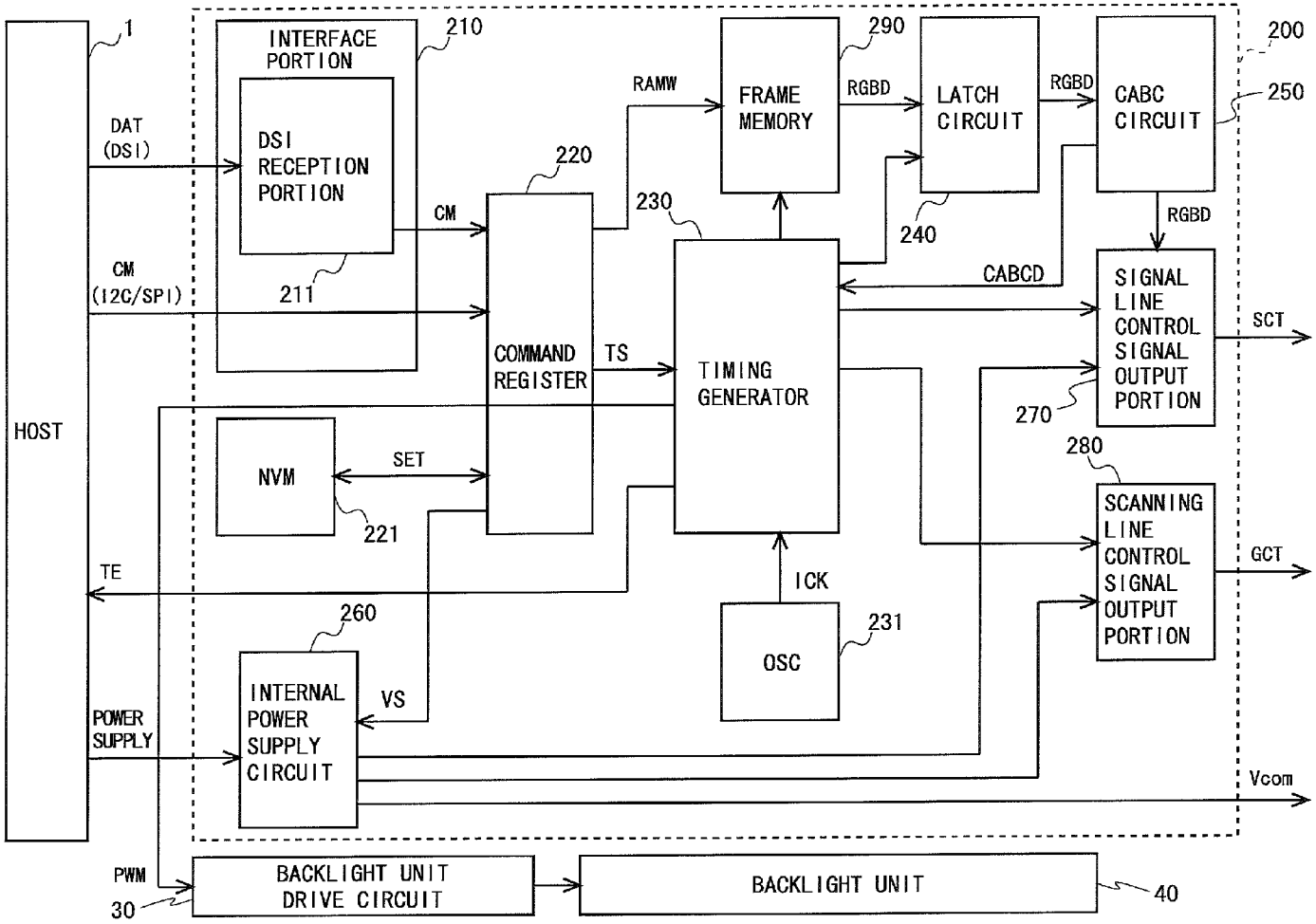
FIG. 4 is a block diagram describing the configuration of a display control circuit supporting the command mode with RAM write in the first embodiment.

FIG. 4 is a block diagram describing the configuration of a display control circuit 200 supporting the command mode with RAM write (referred to below as the "display control circuit 200 for the command mode with RAM write") in the present embodiment. The display control circuit 200 for the command mode with RAM write has the same configuration as the display control circuit 200 for the video mode with RAM capture, except that the data DAT includes different types of data, as shown in FIG. 4.

The data DAT for the command mode includes command data CM, but it does not include any of the following: the RGB data RGBD, the vertical synchronization signal VSYNC, the horizontal synchronization signal HSYNC, the data enable signal DE, and the clock signal CLK. However, the command data CM for the command mode includes data for an image and data for various timings. Among the command data CM, the command register 220 transmits a RAM write signal RAMW, which corresponds to data for an image to be displayed, to the frame memory 290. The RAM write signal RAMW corresponds to the RGB data RGBD described above. Moreover, for the command mode, the timing generator 230 does not receive the vertical synchronization signal VSYNC and the horizontal synchronization signal HSYNC, and therefore, an internal vertical synchronization signal IVSYNC and an internal horizontal synchronization signal IHSYNC, which correspond to such signals, are internally generated in accordance with an internal clock signal ICK and a timing control signal TS. In accordance with the internal vertical synchronization signal IVSYNC and the internal horizontal synchronization signal IHSYNC, the timing generator 230 controls the latch circuit 240, the signal line control signal output portion 270, the scanning line control signal output portion 280, and the frame memory 290. Moreover, the timing generator 230 transmits a transmission control signal TE, which corresponds to the vertical synchronization output signal VSOUT, to the host 1.

<1.3 Operations>

Figure 5:
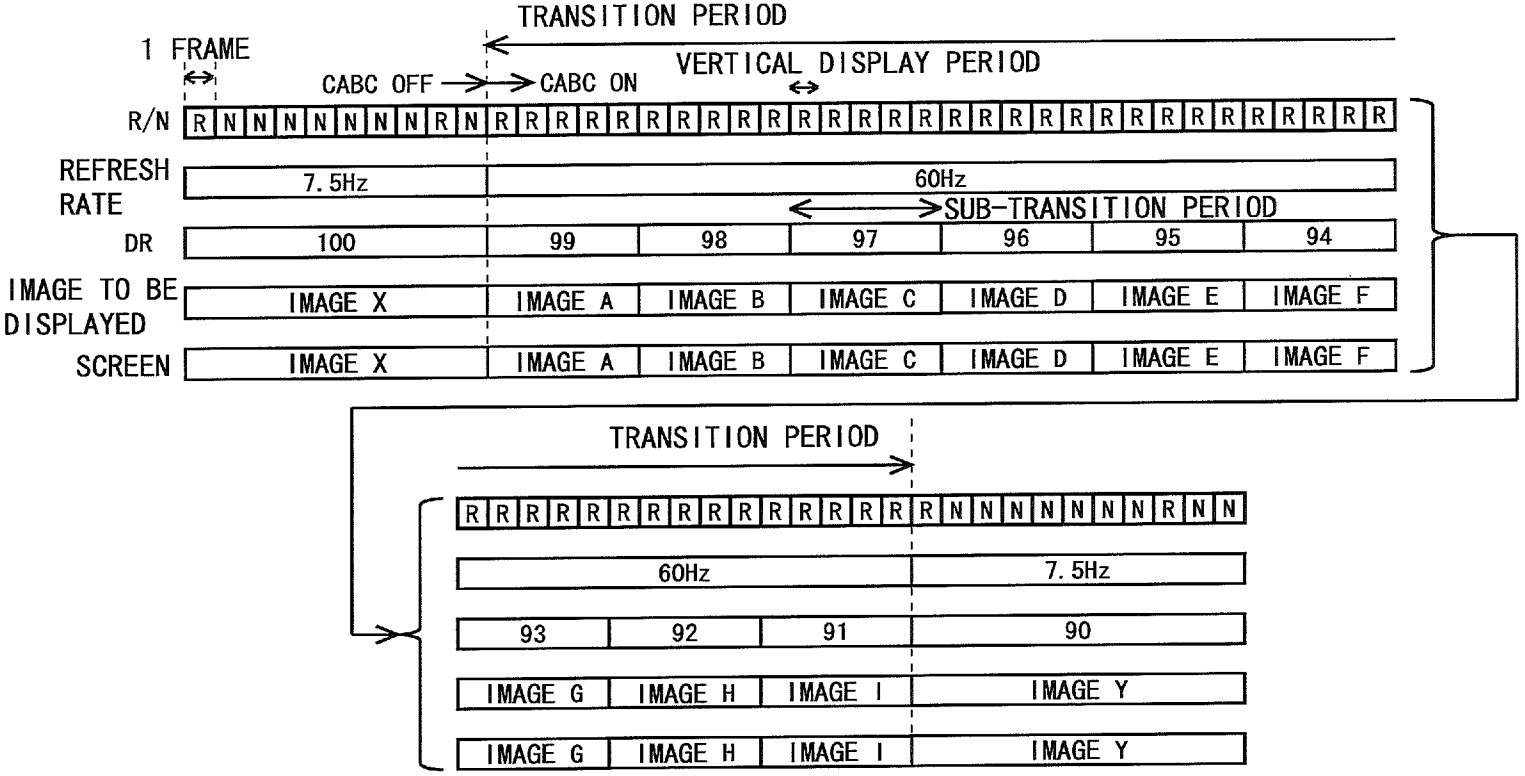
FIG. 5 is a diagram describing an operational example of a liquid crystal display device in the first embodiment.

FIG. 5 is a diagram describing an operational example of the liquid crystal display device 2 in the present embodiment. In the example described, images to be displayed are changed from bright image X, which is a first image, to dark image Y, which is a second image. FIG. 5 shows, from top, the type of frame (R/N), the refresh rate, the duty cycle DR of a pulse-width modulation signal PWM, and the image to be displayed. In the example shown in FIG. 5, there are two types of drive, i.e., pause drive, which is drive at less than 60 Hz (e.g., 7.5 Hz), and normal drive, which is 60-Hz drive. The operations to be described below are basically the same for all of the video mode without RAM, the video mode with RAM capture, and the command mode with RAM write. Here, the normal drive in the present embodiment refers to drive for refreshing the screen every frame. Moreover, the pause drive in the present embodiment refers to drive in which a predetermined number of refresh frames are followed by a predetermined number of no-refresh frames, and the refresh and no-refresh frames are repeated alternatingly. In FIG. 5, each rectangular box corresponding to the type of frame represents one frame, "R" is assigned to the refresh frame, and "N" is assigned to the no-refresh frame. Note that in the present embodiment, polarity inversion drive (alternating-current drive) is performed, so that the polarity of a potential written to pixel capacitance Cp is inverted, for example, upon each refresh. Thus, the polarity balance of the liquid crystal voltage can be attained, so that deterioration of the liquid crystal can be suppressed.

Herein, a first period, which is a period from the start of a refresh frame up to the start of another refresh frame immediately following the refresh frame, will be referred to as a "vertical display period". Also, a second period, which is a period corresponding to a phase of a change of the LED intensity during a transition period (or the duration of an image to be displayed which corresponds to that phase), will be referred to as a "sub-transition period". The duration of each of the vertical display period and the sub-transition period is given in the number of frames.

In the refresh frame, screen refresh is performed, as described above. More specifically, the signal line drive circuit 300 supplies drive video signals to the signal lines SL1 to SLm in accordance with a signal line control signal SCT including digital video signals which correspond to RGB data RGBD, and the scanning line drive circuit 400 scans (i.e., sequentially selects) the scanning lines GL1 to GLn in accordance with a scanning line control signal GCT. The TFTs 111 corresponding to the selected scanning lines GL are turned on, so that the voltages of the drive video signals are written in pixel capacitance Cp. In this manner, the screen is refreshed. Thereafter, the TFTs 111 are turned off, and the written voltages, i.e., liquid crystal voltages, are held until the next screen refresh.

In the no-refresh frame, screen refresh is paused, as described above. More specifically, the supplying of the scanning line control signal GCT to the scanning line drive circuit 400 is stopped, or the scanning line control signal GCT is set at a constant potential, whereby the scanning line drive circuit 400 is stopped from operating, so that the scanning lines GL1 to GLn are not scanned. That is, in the no-refresh frame, the voltages of the drive video signals are not written in pixel capacitance Cp. However, the liquid crystal voltages are held, as described above, and therefore, the screen having been refreshed in the immediately preceding refresh frame continues to be displayed. Further, in the no-refresh frame, the supplying of the signal line control signal SCT to the signal line drive circuit 300 is stopped, or the signal line control signal SCT is set at a constant potential, whereby the signal line drive circuit 300 is stopped from operating. In this manner, in the no-refresh frame, the scanning line drive circuit 400 and the signal line drive circuit 300 are stopped from operating, resulting in reduced power consumption. However, the signal line drive circuit 300 may continue to operate. In such a case, it is desirable to output predetermined constant potentials as drive video signals.

Here, frame configuration examples for exemplary refresh rates provided herein will be described. In the case where the refresh rate is 60 Hz, refresh frames are repeated and are not followed by a no-refresh frame. In the case where the refresh rate is 60 Hz, one vertical display period lasts for one frame. In the case where the refresh rate is 12 Hz, one refresh frame is immediately followed by four no-refresh frames. In the case where the refresh rate is 12 Hz, one vertical display period lasts for five frames. In the case where the refresh rate is 7.5 Hz, one refresh frame is immediately followed by seven no-refresh frames. In the case where the refresh rate is 7.5 Hz, one vertical display period lasts for eight frames. As the refresh rate decreases, the proportion of no-refresh frames increases, so that the amount of reduction in power consumption increases.

Data for the numbers of refresh frames and no-refresh frames for each refresh rate (referred to below as "rate data") is included in, for example, command data CM. A timing control signal TS corresponding to rate data is transmitted to the timing generator 230, and drive is performed in accordance with the refresh rate. In this manner, the timing generator 230 functions as a refresh rate control portion. Switching between refresh rates is performed by, for example, rate data for the refresh rate after the switching being transmitted to the command register 220 by the host 1, updating the rate data being held in the command register 220. The timing generator 230 is capable of, for example, transmitting a control signal to the host 1, thereby causing the host 1 to transmit such new rate data. Switching between refresh rates may also be performed in accordance with CABC processing data CABCD transmitted to the timing generator 230 by the CABC circuit 250.

In the present embodiment, a transition period is provided, and in the case where images to be displayed are changed from bright image X to dark image Y, the images to be displayed are changed gradually during the transition period, with corresponding gradual changes made in the duty cycle of the pulse-width modulation signal PWM. When image X is being displayed, DR=100, and when image Y is being displayed, DR=90. During the transition period, the images to be displayed are changed gradually from image A up to image I, and correspondingly, the duty cycle of the pulse-width modulation signal PWM changes gradually from DR=99 to DR=91. That is, images A to I to be displayed correspond to DR=99 to 91, respectively. The relationship among images X, Y, and A to I in terms of brightness are such that image X>image A>image B> . . . >image H>image I>image Y (the same applies to FIGS. 6 and 7 to be described later). In the present embodiment, the duration of one sub-transition period is five frames. However, the duration of one sub-transition period is not limited to this.

Gradual changes in the duty cycle of the pulse-width modulation signal PWM during the transition period are made in accordance with, for example, CABC processing data CABCD transmitted to the timing generator 230 by the CABC circuit 250. Moreover, gradual changes of the images to be displayed during the transition period are made, for example, by the contents of the RGB data RGBD included in the data DAT, which is transmitted to the display control circuit 200 by the host 1, being changed gradually. However, the method for gradually changing the images to be displayed is not limited to this. For example, the images to be displayed may be changed gradually by the CABC circuit 250 performing conversion on the RGB data RGBD.

Figure 11:
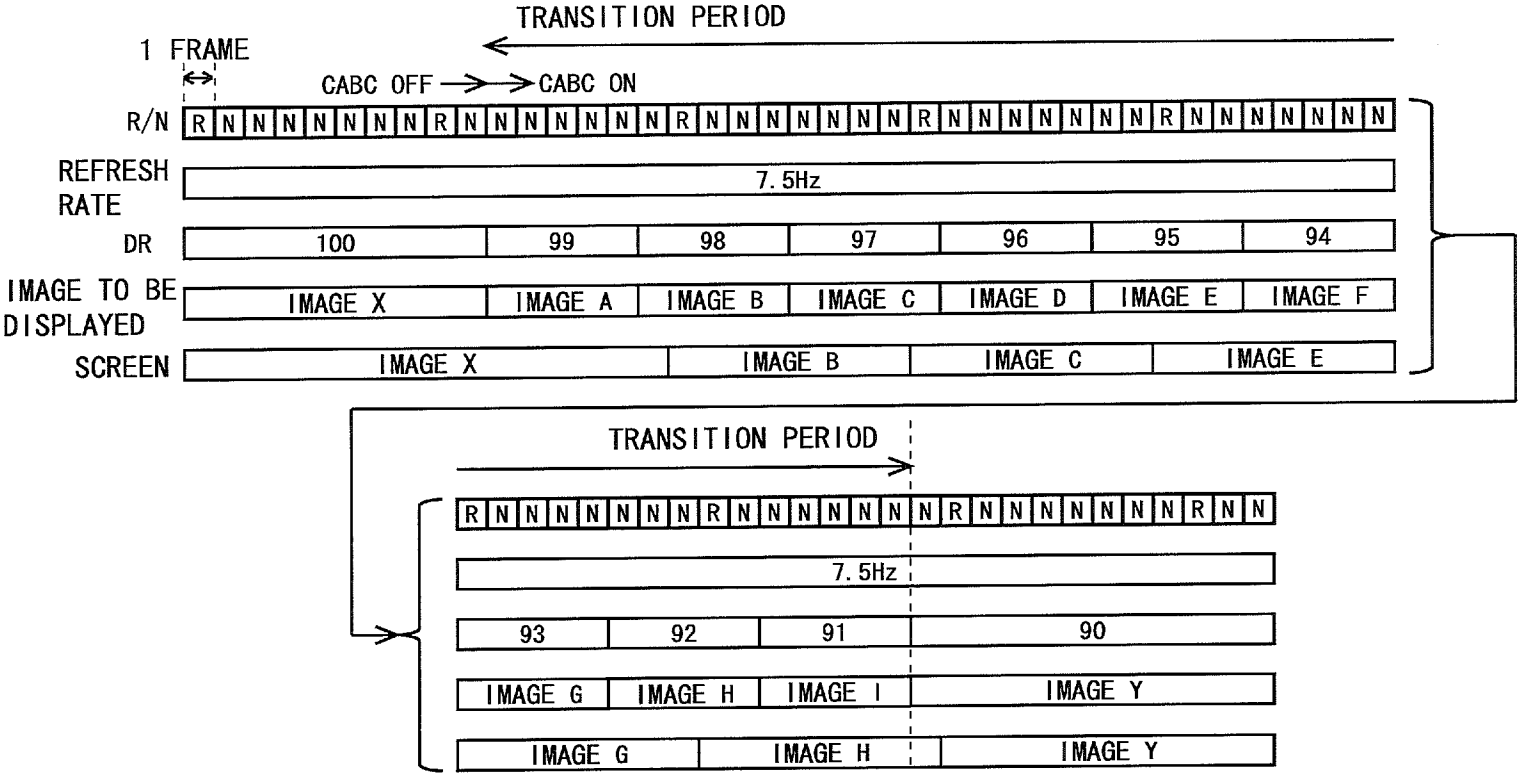
FIG. 11 Conventional Art
FIG. 11 is a diagram describing the operation of a conventional liquid crystal display device with the CABC function.

In the period when image X is displayed on the screen prior to the transition period, 7.5-Hz pause drive is performed. That is, the vertical display period is longer than the sub-transition period, and lasts for eight frames. Conventionally, even after the transition period starts, drive continues to be performed at the same refresh rate as in the period preceding the transition period (see FIG. 11). However, in the present embodiment, once the transition period starts, 7.5-Hz pause drive switches to 60-Hz normal drive, as shown in FIG. 5. During 60-Hz normal drive, the duration of the vertical display period is one frame. Moreover, 60-Hz normal drive continues to the end of the transition period. In this manner, the duration of the vertical display period is set less than or equal to the duration of the sub-transition period, whereby screen refresh is always performed in each sub-transition period within the transition period. More specifically, refresh is performed five times during each sub-transition period.

In the sub-transition period where DR=99, the screen is refreshed to image A. In the sub-transition period where DR=98, the screen is refreshed to image B. In the sub-transition period where DR=97, the screen is refreshed to image C. In the sub-transition period where DR=96, the screen is refreshed to image D. In the sub-transition period where DR=95, the screen is refreshed to image E. In the sub-transition period where DR=94, the screen is refreshed to image F. In the sub-transition period where DR=93, the screen is refreshed to image G. In the sub-transition period where DR=92, the screen is refreshed to image H. In the sub-transition period where DR=91, the screen is refreshed to image I. In this manner, the image displayed on the screen during the transition period corresponds to the duty cycle of the pulse-width modulation signal PWM that should originally correspond to that image. That is, the image displayed on the screen corresponds to the LED intensity that should originally correspond to that image. Note that after the transition period ends, the screen is refreshed to image Y. The start of the first vertical display period of the transition period coincides with the start of the first sub-transition period, as shown in FIG. 5, and the duration of the sub-transition period (five frames) is a natural number multiple of the duration of the vertical display period (one frame), which more reliably ensures that the image displayed on the screen corresponds to the LED intensity that should originally correspond to that image.

<1.4 Effects>

In the present embodiment, the duration of the vertical display period is less than or equal to the duration of the sub-transition period during the transition period. Accordingly, in the case where the CABC function is used during pause drive, the screen is always refreshed in each sub-transition period of the transition period. Therefore, during the transition period, the image displayed on the screen corresponds to the LED intensity that should originally correspond to that image. As a result, during the transition period, the image displayed on the screen has its original brightness. Thus, even in the case where pause drive is performed, as in the case where normal drive is performed, it is possible to sufficiently suppress reduction in display quality due to the use of the CABC function.

Furthermore, in the present embodiment, the start of the first vertical display period of the transition period coincides with the start of the first sub-transition period, and the duration of the sub-transition period (five frames) is a natural number multiple of the duration of the vertical display period (one frame). Thus, it is possible to ensure that the image displayed on the screen corresponds to the LED intensity that should originally correspond to that image.

Furthermore, in the present embodiment, 60-Hz normal drive is performed during the transition period, so that the screen is always refreshed in each sub-transition period of the transition period. Thus, it is possible to more reliably ensure that the image displayed on the screen corresponds to the LED intensity that should originally correspond to that image.

Furthermore, in the present embodiment, an IGZO-TFT is used as the TFT 111 in the image forming portion 110, the voltage written in pixel capacitance Cp can be held reliably. Thus, it is possible to further suppress reduction in display quality, particularly, during pause drive.

<2. Second Embodiment>

<2.1 Operations>

Figure 6:
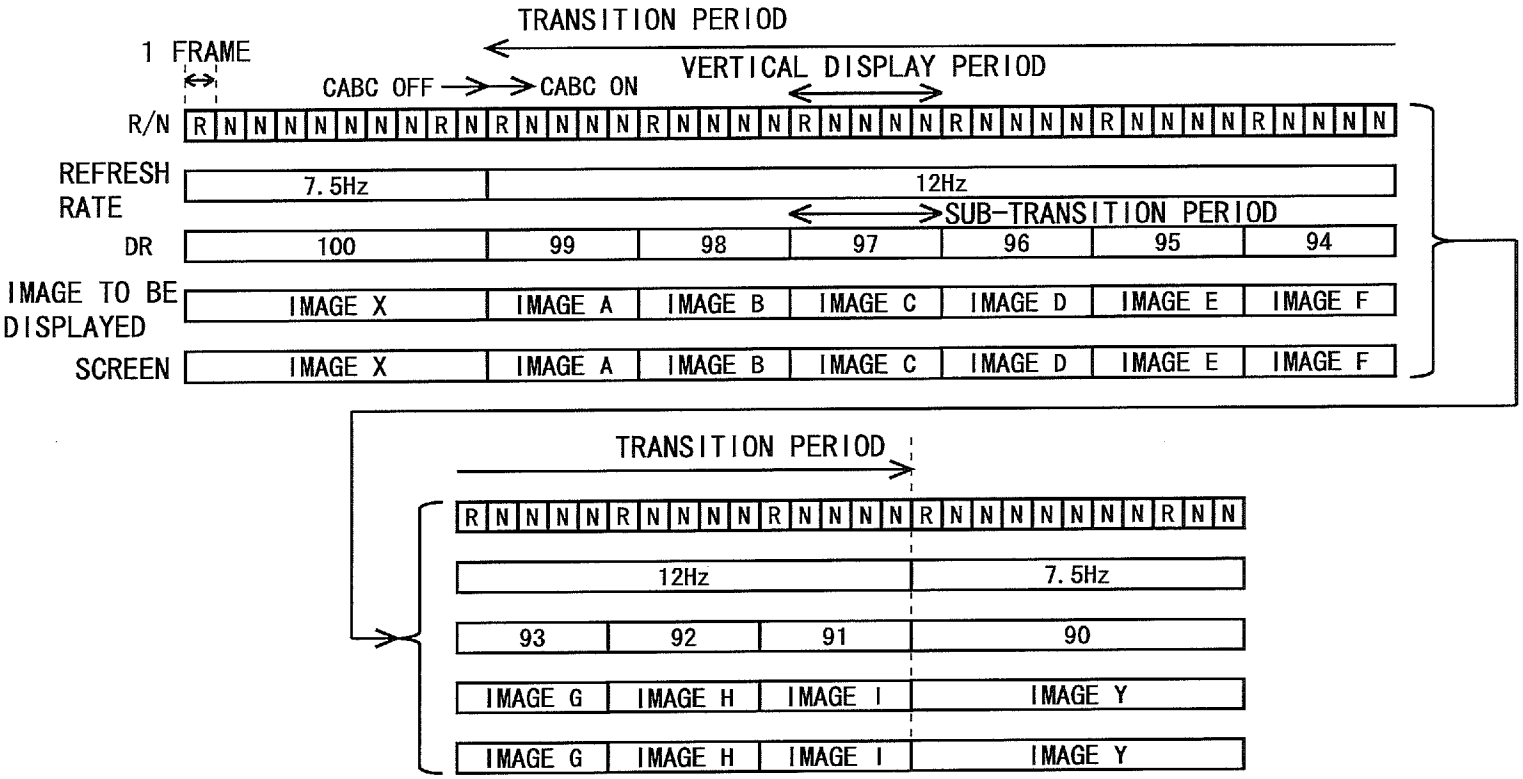
FIG. 6 is a diagram describing an operational example of a liquid crystal display device in a second embodiment of the present invention.

FIG. 6 is a diagram describing an operational example of a liquid crystal display device 2 in a second embodiment of the present invention. Note that the present embodiment is basically the same as the first embodiment except for operations, and therefore, any descriptions of their common points will be omitted. In the present embodiment, as in the first embodiment, the duration of the sub-transition period is five frames, and 7.5-Hz pause drive is performed in the period when image X is displayed on the screen prior to the transition period. That is, the duration of the vertical display period is eight frames. In the first embodiment, once the transition period starts, 7.5-Hz pause drive switches to 60-Hz normal drive, so that the duration of the vertical display period changes from eight frames to one frame.

However, in the present embodiment, once the transition period starts, 7.5-Hz pause drive switches to 12-Hz pause drive. Accordingly, the duration of the vertical display period changes from eight frames to five frames, i.e., the same duration as the sub-transition period. In this manner, the duration of the vertical display period is set to five frames, the same duration as the sub-transition period, so that as in the first embodiment, screen refresh is always performed in each sub-transition period of the transition period. Note that as shown in FIG. 6, the start of the first vertical display period of the transition period desirably coincides with the start of the first sub-transition period.

The present embodiment is not limited by the example shown in FIG. 6. For example, if the duration of the sub-transition period is six frames, switching to 10-Hz pause drive occurs in the transition period, meaning that the duration of the vertical display period changes to six frames. Moreover, if the duration of the sub-transition period is four frames, switching to 15-Hz pause drive occurs in the transition period, meaning that the duration of the vertical display period changes to four frames. Furthermore, such a refresh rate as to make the vertical display period shorter than the sub-transition period may be employed during the transition period. However, the duration of the sub-transition period is desirably a natural number multiple of the duration of the vertical display period. For example, in the case where the duration of the sub-transition period is six frames, it is possible to make a switch to 20-Hz pause drive, such that the duration of the vertical display period becomes three frames (i.e., half the duration of the sub-transition period). Moreover, in the case where the duration of the sub-transition period is 16 frames, it is possible to make a switch to 15-Hz pause drive, such that the duration of the vertical display period becomes four frames (i.e., a quarter of the duration of the sub-transition period).

<2.2 Effects>

In the present embodiment, pause drive is performed during the transition period, and the duration of the vertical display period is the same (1×) as the duration of the sub-transition period. Thus, it is possible to further reduce power consumption compared to the first embodiment while allowing an image displayed on the screen to correspond to the LED intensity that should originally correspond to that image as in the first embodiment.

<3. Third Embodiment>

Figure 7:
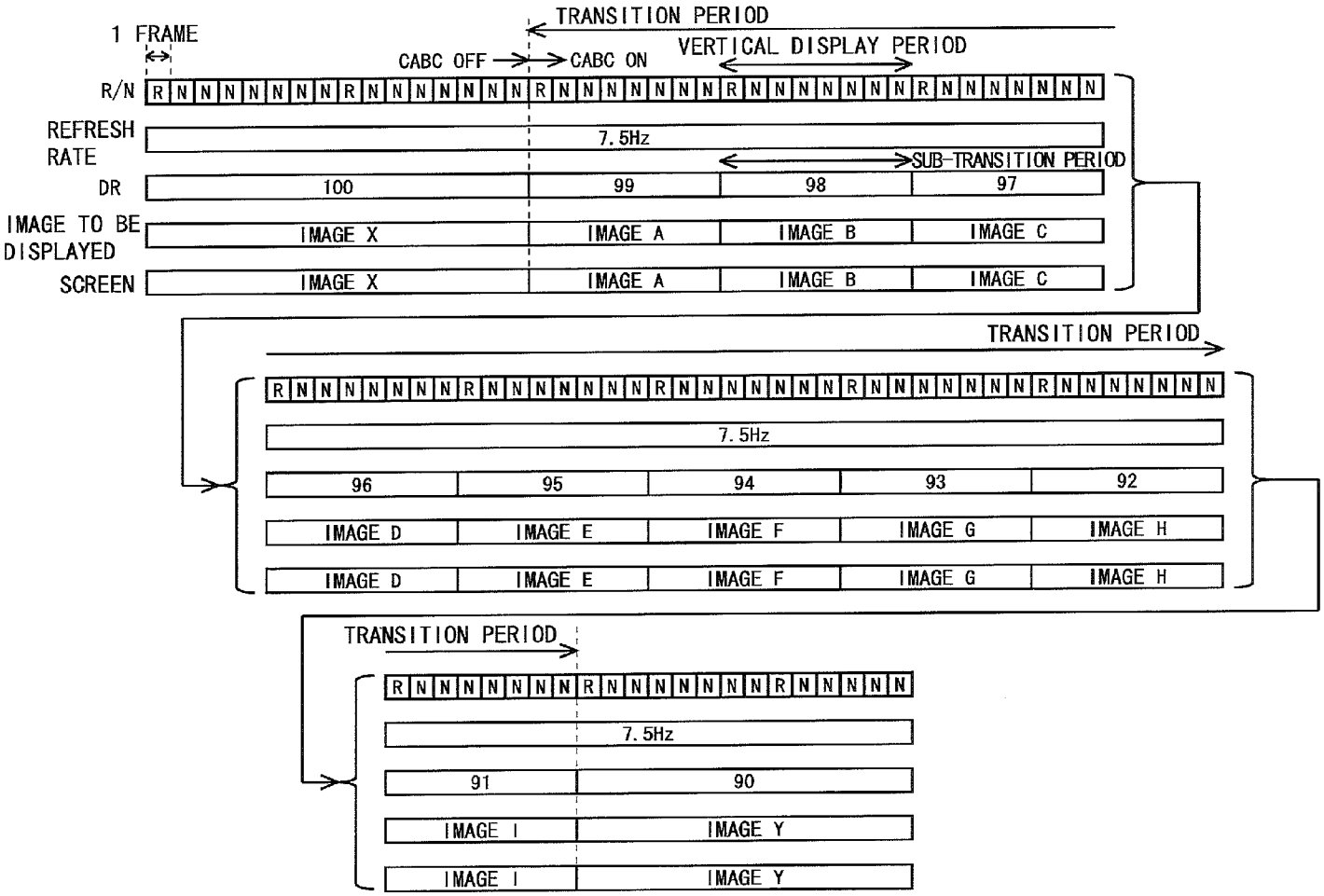
FIG. 7 is a diagram describing an operational example of a liquid crystal display device in a third embodiment of the present invention.

<3.1 Operations>FIG. 7 is a diagram describing an operational example of a liquid crystal display device 2 in a third embodiment of the present invention. Note that the present embodiment is basically the same as the first embodiment except for operations, and therefore, any descriptions of their common points will be omitted. In the present embodiment, as in the first embodiment, the duration of the sub-transition period is five frames, and 7.5-Hz pause drive is performed in the period where image X is displayed on the screen prior to the transition period, as in the first embodiment. That is, the duration of the vertical display period is eight frames. In the first embodiment, once the transition period starts, 7.5-Hz pause drive switches to 60-Hz normal drive, so that the duration of the vertical display period changes from eight frames to one frame. In the present embodiment, even after the transition period starts, 7.5-Hz pause drive continues to be performed. That is, the duration of the vertical display period remains the same, i.e., eight frames, as that before and after the transition period. In this manner, the duration of the vertical display period does not vary between the transition period and other periods, which is the same as in the case of conventional liquid crystal display devices (see FIG. 11).

However, in the present embodiment, unlike in conventional liquid crystal display devices, once the transition period starts, the duration of the sub-transition period is set to eight frames, i.e., the same duration as the vertical display period. The setting method is, for example, as follows. The timing generator 230 changes the timing of controlling the latch circuit 240 and so on in accordance with the duration of the vertical display period (i.e., the refresh rate). As a result, the contents of the CABC processing data CABCD and the RGB data RGBD transmitted by the CABC circuit 250 are changed in accordance with the duration of the vertical display period. That is, the CABC circuit 250 sets the duration of the sub-transition period in accordance with the duration of the vertical display period. However, the method for setting the duration of the sub-transition period is not limited to this, and any method can be employed so long as the duration of the sub-transition period is set by a component of the electronic device.

In this manner, the duration of the sub-transition period is set to eight frames, the same duration as the vertical display period, so that screen refresh is always performed in each sub-transition period of the transition period, as in the first embodiment. Note that to allow the image displayed on the screen to correspond to the LED intensity that should originally correspond to that image, it is desirable to switch between refresh rates such that the first frame of the sub-transition period is a refresh frame. Note that screen refresh is always performed in each sub-transition period, as shown in FIG. 7. Note that the start of the first vertical display period of the transition period desirably coincides with the start of the first sub-transition period, as shown in FIG. 6.

The present embodiment is not limited by the example shown in FIG. 7. For example, when 12-Hz pause drive is performed, i.e., the duration of the vertical display period is five frames, the duration of the sub-transition period is five frames. Moreover, when 10-Hz pause drive is performed, i.e., the duration of the vertical display period is six frames, the duration of the sub-transition period is six frames. The sub-transition period may be set longer than the vertical display period. However, the duration of the sub-transition period is desirably a natural number multiple of the duration of the vertical display period. For example, in the case where the duration of the vertical display period is eight frames, the duration of the sub-transition period can be set to 16 frames (i.e., twice as long as the display period). Moreover, in the case where the duration of the vertical display period is four frames, the duration of the sub-transition period can be set to 16 frames (i.e., four times as long as the vertical display period).

<3.2 Effects>

In the present embodiment, pause drive is performed during the transition period, and the duration of the sub-transition period is the same (1×) as the duration of the vertical display period. Thus, the same effects as those achieved by the second embodiment can be achieved. Further, it is not necessary to change the refresh rate during the transition period. Thus, it is possible to further reduce power consumption compared to the second embodiment.

<4. Fourth Embodiment>

<4.1 Configurations of the Host and the Display Control Circuit>

In the first embodiment, the CABC circuit 250 is provided in the display control circuit 200. However, in the present embodiment, the CABC circuit 250 is provided in the host 1. Note that the present embodiment is basically the same as the first embodiment, except for the configuration of the host 1 and the configuration of the display control circuit 200, and therefore, any descriptions of their common points will be omitted. Further, among the components of the present embodiment, the same components as in the first embodiment are denoted by the same reference characters, and any descriptions thereof will be omitted for the sake of convenience.

Figure 8:
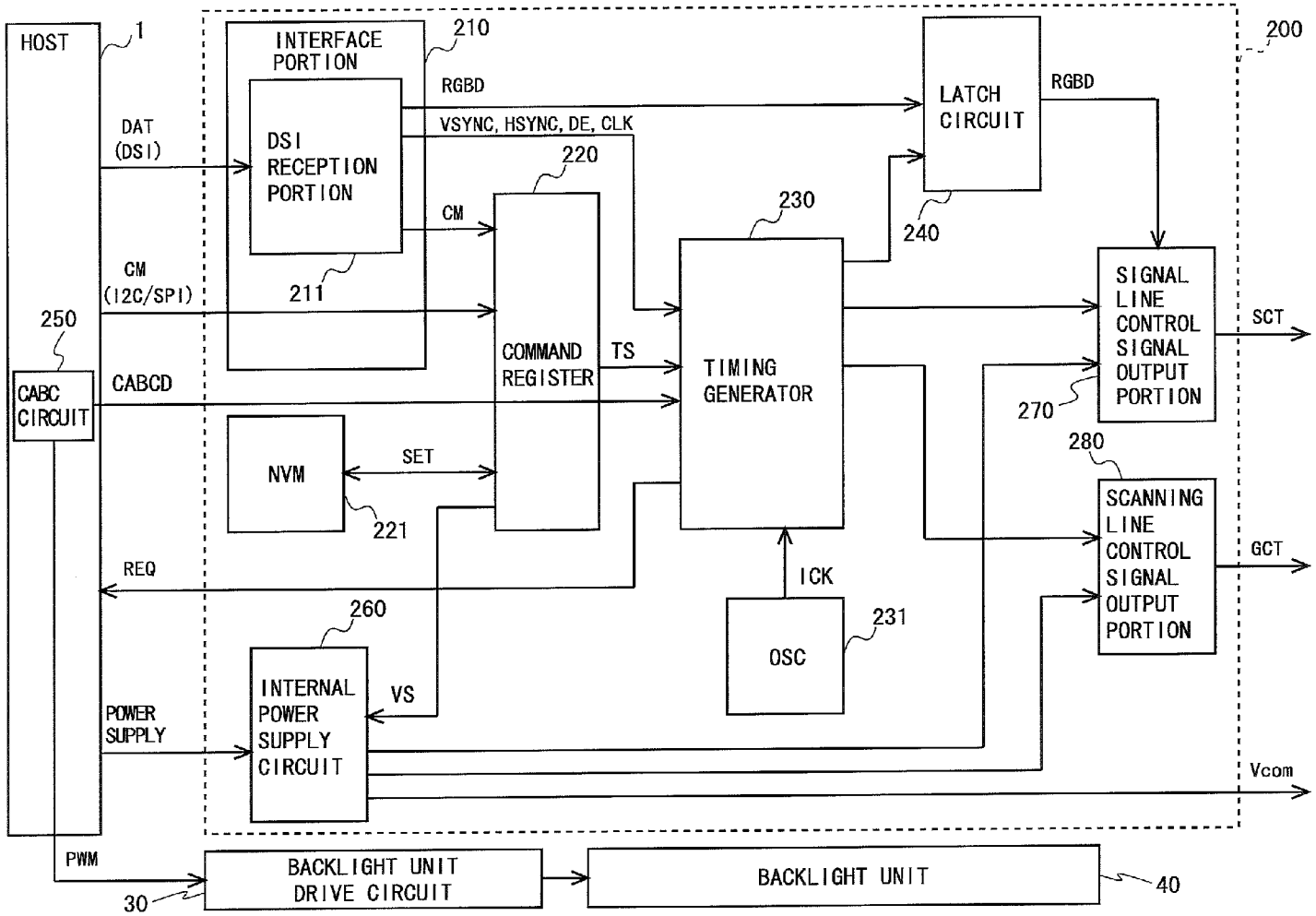
FIG. 8 is a block diagram describing the configuration of a host and the configuration of a display control circuit supporting the video mode without RAM in a fourth embodiment of the present invention.

FIG. 8 is a block diagram describing the configuration of the host 1 and the configuration of the display control circuit 200 for the video mode without RAM in the present embodiment. In the present embodiment, the CABC circuit 250 is provided in the host 1, rather than in the display control circuit 200, as shown in FIG. 8. In the present embodiment, the CABC circuit 250 transmits the CABC processing data CABCD to the timing generator 230. Further, the CABC circuit 250 generates the pulse-width modulation signal PWM, which, in the first embodiment, is generated by the timing generator 230, and outputs the pulse-width modulation signal PWM to the backlight unit drive circuit 30.

In the present embodiment, as in the first embodiment, the CABC processing data CABCD indicates the brightness of the image to be displayed that is represented by the RGB data RGBD included in the data DAT, and/or a change in brightness compared to the image represented by the immediately preceding RGB data RGBD. Moreover, in the present embodiment, the CABC processing data CABCD may be 1-bit data indicating whether the pulse-width modulation signal PWM generated by the CABC circuit 250 is experiencing a change or not. In addition, the CABC processing data CABCD may be transmitted to the timing generator 230 directly or via the command register 220.

In the present embodiment, as in the first embodiment, switching between refresh rates is performed by updating the rate data held in the command register 220. Moreover, switching between refresh rates may be performed on the basis of the CABC processing data CABCD transmitted to the timing generator 230 by the CABC circuit 250.

In the first embodiment, for example, the CABC circuit 250 in the display control circuit 200 performs LED intensity-adapted data conversion on the RGB data RGBD. On the other hand, in the present embodiment, for example, the CABC circuit 250 in the host 1 performs LED intensity-adapted data conversion on RGB data RGBD included in data DAT to be transmitted to the display control circuit 200 by the host 1.

Figure 9:
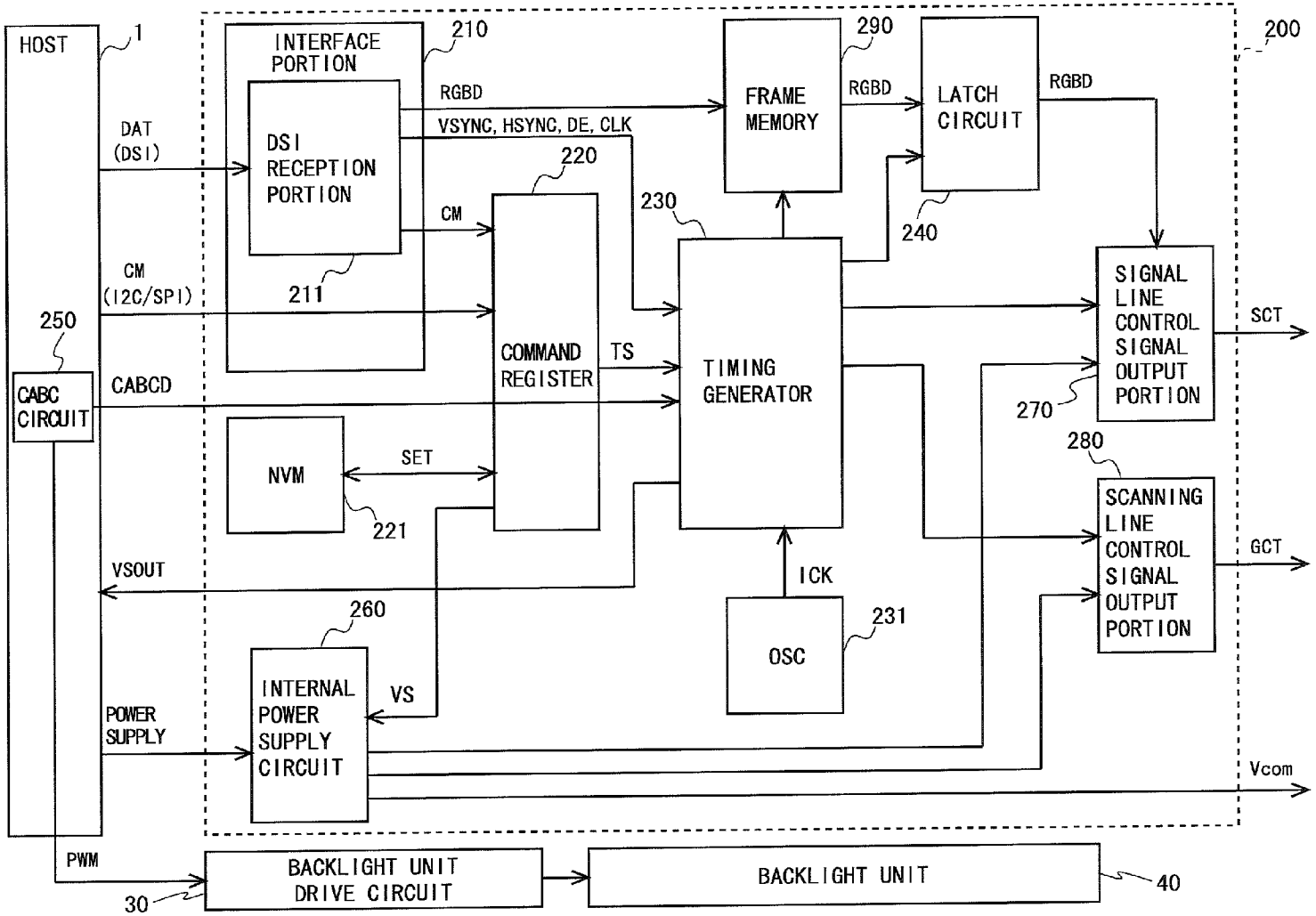
FIG. 9 is a block diagram describing the configuration of a host and the configuration of a display control circuit supporting the video mode with RAM capture in the fourth embodiment.

FIG. 9 is a block diagram describing the configuration of the host 1 and the configuration of the display control circuit 200 for the video mode with RAM capture in the present embodiment. In the present embodiment, the CABC circuit 250 is provided in the host 1, rather than in the display control circuit 200, as shown in FIG. 9. Note that the CABC circuit 250, the timing generator 230, etc., shown in FIG. 9 operate in the same manner as those shown in FIG. 8, and therefore, any descriptions thereof will be omitted.

Figure 10:
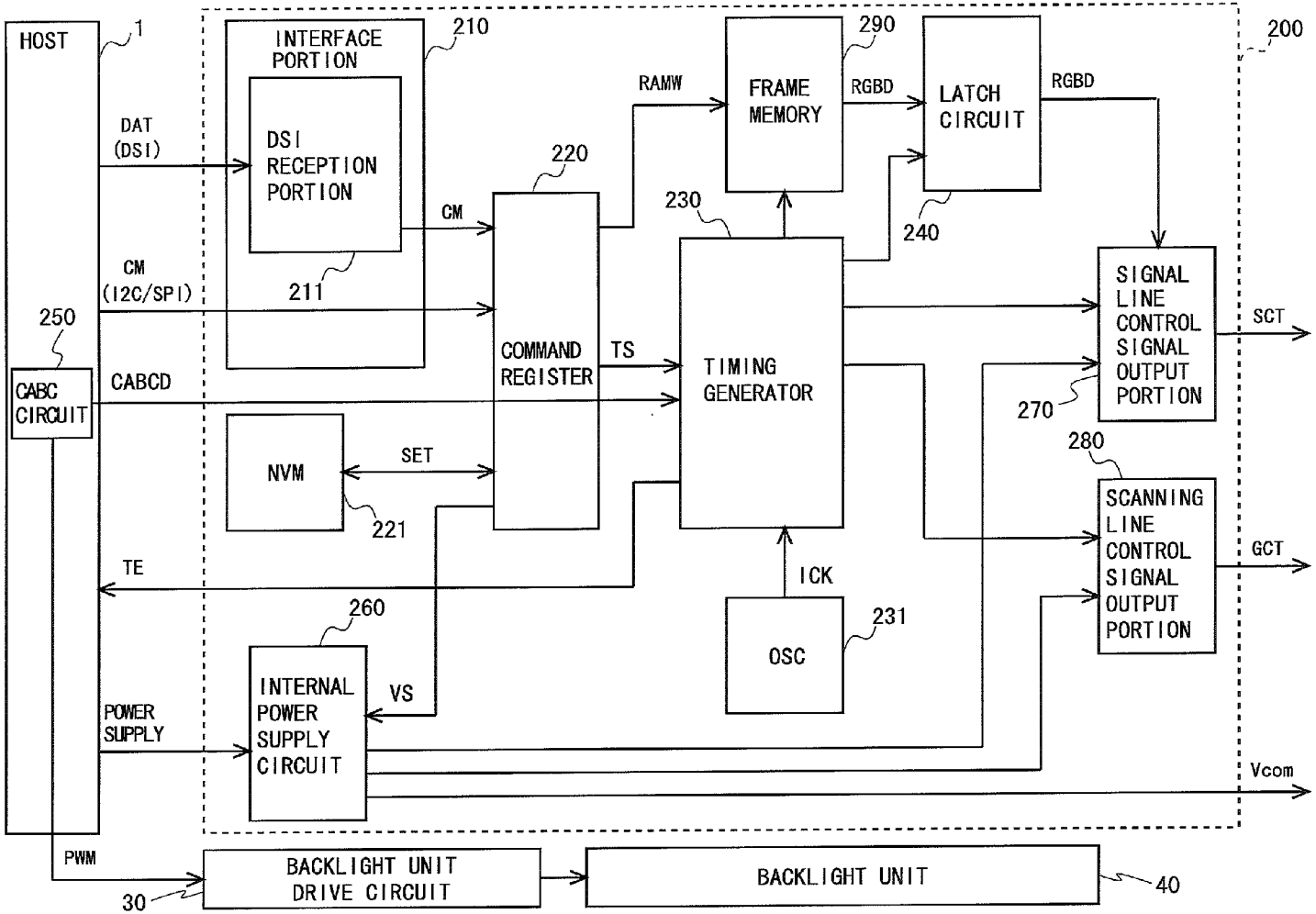
FIG. 10 is a block diagram describing the configuration of a host and the configuration of a display control circuit supporting the command mode with RAM write in the fourth embodiment.

FIG. 10 is a block diagram describing the configuration of the host 1 and the configuration of the display control circuit 200 for the command mode with RAM write in the present embodiment. In the present embodiment, the CABC circuit 250 is provided in the host 1, rather than in the display control circuit 200, as shown in FIG. 10. The CABC circuit 250, the timing generator 230, etc., shown in FIG. 10 operate basically in the same manner as those shown in FIG. 8. However, as for the LED intensity-adapted data conversion by the CABC circuit 250, unlike in the example for the video mode without RAM, the CABC circuit 250 in the host 1 performs the LED intensity-adapted data conversion on, for example, a RAM write signal RAMW corresponding to data for the image to be displayed from among the command data CM included in the data DAT to be transmitted to the display control circuit 200 by the host 1.

<4.2 Effects>

In the present embodiment, the same effects as those achieved by the first embodiment can be achieved in the modes for which the CABC circuit 250 is provided in the host 1.

<5. Others>

The above embodiments have been described taking examples where the images to be displayed are changed from bright image X, which is a first image, to dark image Y, which is a second image, but the present invention is not limited by such examples. The present invention can be applied to the case where the images to be displayed are changed from dark image Y, which is a first image, to bright image X, which is a second image. In this case as well, the same effects as those achieved by the embodiments can be achieved.

The above embodiments have been described with respect to the modes using the interfaces that support the DSI standard, but interfaces that support other standards may be used.

The first embodiment has been described taking as examples the modes for which the CABC circuit 250 is provided in the display control circuit 200, and the fourth embodiment has been described taking as examples the modes for which the CABC circuit 250 is provided in the display control circuit 200, but the present invention is not limited by these examples. The CABC circuit 250 may be provided outside both the host 1 and the display control circuit 200. Note that in the case where the CABC circuit 250 is provided in the liquid crystal display device 2 but outside the display control circuit 200, the CABC circuit 250 and the display control circuit 200 collectively function as a control portion.

The fourth embodiment may be used in combination with the second embodiment or the third embodiment. Note that in the case where the fourth embodiment is used in combination with the third embodiment, the setting of the duration of the sub-transition period in accordance with the duration of the vertical display period is performed, for example, by the CABC circuit 250 of the host 1 setting the duration of the sub-transition period in accordance with data corresponding to the command data CM on which the timing control signal CS and the rate data are based.

In addition, various modifications can be made to the embodiments without departing from the spirit of the present invention.

As described above, the present invention renders it possible to provide a display device capable of suppressing reduction in display quality even when pause drive is performed, while allowing the intensity of a light source to be changed in accordance with an image to be displayed, and the invention also renders it possible to provide an electronic device including the display device and a method for driving the display device.

Industrial Applicability

The present invention can be applied to display devices in which pause drive is performed, electronic devices including the display devices, and methods for driving the display device drives.

DESCRIPTION OF THE REFERENCE CHARACTERS

1 host
2 liquid crystal display device
10 liquid crystal display panel
20 FPC
30 backlight unit drive circuit (light source drive portion)
40 backlight unit
100 display portion
110 image forming portion
111 TFT (thin-film transistor)
200 display control circuit
210 interface portion
211 DSI reception portion
220 command register
221 NVM (non-volatile memory)
230 timing generator (refresh rate control portion)
231 OSC (oscillator)
240 latch circuit
250 CABC circuit (intensity control portion)
260 internal power supply circuit
270 signal line control signal output portion
280 scanning line control signal output portion
290 frame memory (RAM)
300 signal line drive circuit
400 scanning line drive circuit
SL signal line
GL scanning line
R refresh
N no-refresh

The invention claimed is:

1. A display device with a display portion and a light source, the display portion including a plurality of image forming portions, the light source illuminating the display portion and having an intensity changeable in accordance with images to be displayed on a screen of the display portion, the display device comprising:

a display drive portion for driving the display portion;

a light source drive portion for driving the light source; and a control portion for controlling the display drive portion in accordance with externally received data, wherein, the control portion includes a refresh rate control portion for controlling a refresh rate determined in accordance with the proportion of a refresh period for refreshing the screen and a no-refresh period for pausing the refreshing of the screen, and in a transition period in which the intensity of the light source gradually changes in accordance with gradual changes of the images to be displayed from a first image to a second image, a first period from the start of the refresh period to the start of another refresh period immediately following the refresh period has a duration less than or equal to a duration of a second period corresponding to a phase of the change in intensity of the light source.

2. The display device according to claim 1, wherein the control portion further includes an intensity control portion for performing control to change the intensity of the light source in accordance with data included in the externally received data and representing the images to be displayed.

3. The display device according to claim 2, wherein the refresh rate control portion changes the refresh rate such that the first period of the transition period is the refresh period.

4. The display device according to claim 2, wherein the first period of the transition period includes the refresh period and the no-refresh period.

5. The display device according to claim 4, wherein the refresh rate control portion sets the duration of the first period of the transition period in accordance with the duration of the second period.

6. The display device according to claim 4, wherein the intensity control portion sets the duration of the second period of the transition period in accordance with the duration of the first period.

7. The display device according to claim 1, wherein the duration of the second period is a natural number multiple of the duration of the first period.

8. The display device according to claim 1, wherein the image forming portion includes a thin-film transistor with a control terminal connected to a scanning line in the display portion, a first conductive terminal connected to a signal line in the display portion, a second conductive terminal to which a voltage in accordance with the image to be displayed is applied, the second conductive terminal being connected to a pixel electrode in the display portion, and a channel layer made of an oxide semiconductor.

9. An electronic device comprising:

a display device of claim 1; and an intensity control portion for performing control to change the intensity of the light source in accordance with the images to be displayed.

10. The electronic device according to claim 9, wherein the refresh rate control portion changes the refresh rate such that the first period of the transition period is the refresh period.

11. The electronic device according to claim 9, wherein the first period of the transition period includes the refresh period and the no-refresh period.

12. The electronic device according to claim 11, wherein the refresh rate control portion sets the duration of the first period of the transition period in accordance with the duration of the second period of the transition period.

13. The electronic device according to claim 11, wherein the intensity control portion sets the duration of the second period of the transition period in accordance with the duration of the first period.

14. The electronic device according to claim 9, wherein the image forming portion includes a thin-film transistor with a control terminal connected to a scanning line in the display portion, a first conductive terminal connected to a signal line in the display portion, a second conductive terminal to which a voltage in accordance with the image to be displayed is applied, the second conductive terminal being connected to a pixel electrode in the display portion, and a channel layer made of an oxide semiconductor.

15. A method for driving a display device with a display portion including a plurality of image forming portions, a display drive portion for driving the display portion, a light source for illuminating the display portion, a light source drive portion for driving the light source, and a control portion for controlling the display drive portion in accordance with externally received data, the method comprising:

a transition step of setting a duration of a first period of a transition period to be less than or equal to a duration of a second period, the transition period being a period in which the intensity of the light source gradually changes in accordance with gradual changes of the images to be displayed from a first image to a second image, the first period lasting from the start of a refresh period for refreshing the screen to the start of another refresh period immediately following the refresh period, the second period corresponding to a phase of the change in intensity of the light source, wherein, the transition step includes a refresh rate control step of controlling a refresh rate determined in accordance with the proportion of the refresh period and a no-refresh period for pausing the refreshing of the screen.

16. The drive method according to claim 15, wherein in the refresh rate control step, the refresh rate is changed such that the first period of the transition period is the refresh period.

17. The drive method according to claim 15, wherein the first period of the transition period includes the refresh period and the no-refresh period.

18. The drive method according to claim 17, wherein in the refresh rate control step, the duration of the first period of the transition period is set in accordance with the duration of the second period.

19. The drive method according to claim 17, wherein in the transition step, the duration of the second period of the transition period is set in accordance with the duration of the first period.

20. The drive method according to claim 15, wherein in the transition step, the duration of the second period is set to a natural number multiple of the duration of the first period.

* * * * *